United States Patent [19]

Beck

[11] 4,386,296

[45] May 31, 1983

[54] FLUORESCENT LIGHT UNIT WITH DUAL LIGHT LEVELS

[75] Inventor: Charles E. Beck, Chesterland, Ohio

[73] Assignee: General Electric Company, Schenectady, N.Y.

[21] Appl. No.: 218,042

[22] Filed: Dec. 19, 1980

[51] Int. Cl.[3] ..... H05B 41/18; H05B 41/42

[52] U.S. Cl. ..... 315/53; 315/58; 315/62; 315/100; 315/291; 315/309; 315/DIG. 4

[58] Field of Search ..... 315/53, 58, 62, 100, 315/101, 106, 291, 309, DIG. 4, DIG. 5; 362/216

[56] References Cited

U.S. PATENT DOCUMENTS

| | | | |
|---|---|---|---|
| 2,320,424 | 6/1943 | Gates | 315/100 |
| 2,350,462 | 6/1944 | Johns | 362/216 |
| 2,652,483 | 9/1953 | Laidig | 362/216 |
| 2,817,004 | 12/1957 | Baumgartner et al. | 362/216 |
| 3,028,525 | 4/1962 | Morton | 315/DIG. 4 |
| 3,836,814 | 9/1974 | Rodriquez | 315/51 |
| 4,178,535 | 12/1979 | Miller | 315/53 |
| 4,284,925 | 8/1981 | Bessone et al. | 315/53 X |

*Primary Examiner*—Eugene R. La Roche

*Attorney, Agent, or Firm*—Norman C. Fulmer; Philip L. Schlamp; Fred Jacob

[57] ABSTRACT

A screw-in fluorescent light unit having two light levels, for use in a 3-way socket. A reactor ballasts the lamp for high light output, and a positive temperature coefficient resistor (thermistor) is added to ballast the lamp for low light output and to facilitate lamp starting at the low light output. The light-level sequence is off-high-low-high-off.

11 Claims, 4 Drawing Figures

11
12
13
14
15
16
17
18
19
21
22
23
24
31
32

21
24
26
27

21
24
28

PTC RESISTOR INPUT VOLTS
PTC RESISTOR VOLTS
LAMP CURRENT
0
36
37
38
46
52
42
47
51
43
56
LAMP STARTING
LAMP OPERATING
39
41
TIME

FLUORESCENT LIGHT UNIT WITH DUAL LIGHT LEVELS

CROSS-REFERENCES TO RELATED APPLICATIONS

Ser. No. 218,043, now U.S. Pat. No. 4,358,709, Donald E. Magai, "Fluorescent Light Unit with Dual Light Levels", filed concurrently herewith and assigned the same as this invention.

Ser. No. 218,020, now U.S. Pat. No. 4,358,710, Donald E. Magai, "Fluorescent Light Unit with Dimmable Light Level", filed concurrently herewith and assigned the same as this invention.

Ser. No. 47,985, now U.S. Pat. No. 4,278,911, Rudolph Metoff, "Circular Fluorescent Lamp Unit", filed June 13, 1979 and assigned the same as this invention.

BACKGROUND OF THE INVENTION

The invention is in the field of light units, such as screw-in circular fluorescent lights, and light units having selectable light levels such as bright and dim.

Three-way incandescent light bulbs have been popular for many years, for use in situations where differing light levels are desirable under differing conditions, and to conserve electrical power consumption by adjusting the light level to the lowest value suitable for the needed visual task. Fluorescent lamp units are more electrically efficient than incandescent lamps, and ways have been proposed for providing multiple-light level fluorescent lamp units. For example, U.S. Pat. Nos. 2,350,462 to Johns, 2,652,483 to Laidig, and 4,178,535 to Miller, disclose ways of providing selectably different light levels for circular fluorescent lights by inserting different reactive ballast elements, or different transformer winding turns, in series with the lamp bulbs. The general idea of a screw-in ballasted fluorescent lamp unit has been known, for example, by the disclosure in U.S. Pat. Nos. 2,320,424 to Gates and 2,817,004 to Baumgartner.

SUMMARY OF THE INVENTION

Objects of the invention are to provide a feasible and low-cost multiple light level fluorescent lamp unit.

The invention comprises, briefly and in a preferred embodiment, a fluorescent light unit having a fluorescent lamp bulb (such as a circular type), a starter switch connected between the bulb's cathodes, a reactor ballast connected in series with the lamp bulb for high-level light output, and a positive temperature coefficient resistor (thermistor) selectively connected in series with the reactor to provide low-level light output, and to facilitate lamp starting at the low-level light setting. The circuit is arranged so that the light-level sequence is off-high-low-high-off.

DESCRIPTION OF THE PREFERRED EMBODIMENTS

Figure 1:
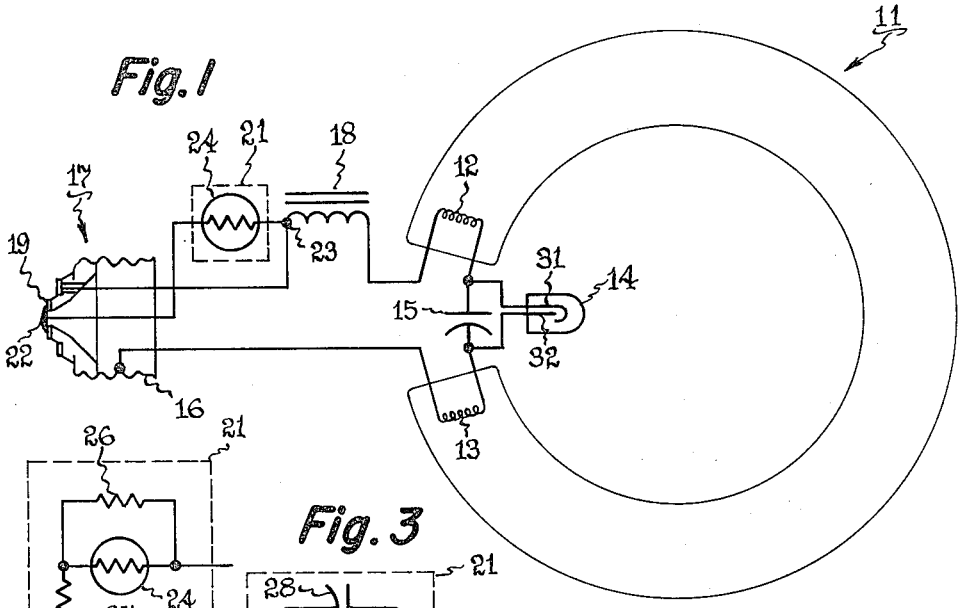
FIG. 1 is an electrical diagram of a preferred embodiment of the invention.
Figure 2:
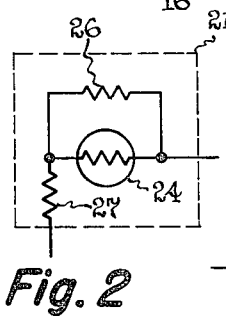
FIGS. 2 and 3 show alternative embodiments of a portion of FIG. 1.

As shown in FIG. 1, a fluorescent light bulb 11, preferably of a circular type known as Circline, is provided with cathodes 12 and 13 within the bulb and near the ends thereof. A conventional glow-starter switch 14 is connected between an end of each of the cathodes 12 and 13 and a capacitor 15 is connected across the starter 14 as is conventional. The remaining end of cathode 13 is electrically connected to the threaded shell 16 of a conventional three-way lamp screw-base 17. The remaining end of cathode 12 is connected via a ballast reactor 18 to a terminal such as the ring terminal 19 of the base 17. The reactor 18 has a value to cause "high-level" light output to be produced by the bulb 11 when electrical power is applied, via a conventional three-way lamp socket, to the shell 16 and ring terminal 19 of base 17. A "low-level" light circuit 21 is connected between the center "button" terminal 22 of the base 17 and the end 23 of reactor 18 which is connected to the ring terminal 19. In FIG. 1, the low-light level circuit 21 comprises a positive temperature coefficient resistor 24 (also known as a thermistor) connected between the center base terminal 22 and the reactor end 23. In the FIG. 2 alternative low-level ballast, a resistor 26 is connected in parallel with, and/or a resistor 27 is connected in series with, the termistor 24, and in the FIG. 3 alternative a capacitor 28 is connected across the termistor 24. The low light level circuit 21 may be placed in the central hub of the light unit disclosed in the above-referenced Metoff patent application, along with the reactor 18, the 3-way base 17 being attached to the end of the hub. The lamp 11, starter switch 14, and reactor 18 may be the same as disclosed in Metoff.

When the screw base 17 is inserted in a conventional three-way socket the shell 16 is connected to one side of the a.c. electrical power. When the socket switch is in the "off" position, no power is applied to either the ring terminal 19 nor the center terminal 22, and no light is produced. When the socket switch is turned to its next (first) position, electrical power is provided to the ring terminal 19 (and to the low-light filament of a conventional incandescent 3-way bulb). In the next (second) switch position, power is applied to the center terminal 22 (and to a second and brighter filament of a conventional 3-way bulb, for "medium" light). The third switch position connects electrical power to both the ring terminal 19 and the center terminal 22 (so that both filaments of a 3-way incandescent bulb light up resulting in "high" light level). The next socket switch position is again "off".

When a two-level light system is connected to a three-way lamp socket, as in the present invention, there is a choice available in light-level sequence. In accordance with a feature of the invention shown and disclosed, herein, the light-level sequence of light bulb 11 is "off-high-low-high-off", because the first socket switch position activates the ring contact 19 and operates the bulb 11 on "high" via reactor 18; the second socket switch position activates the center terminal 22 and operates the bulb 11 on "low" via the series-connected reactor 18 and resistor 24; and the third socket switch position activates both the ring terminal 19 and center terminal 22, again operating the bulb 11 on "high" via the reactor 18 (the "low" impedance 21 being shorted out between terminals 19 and 22); the next switch position is again "off". This light level sequence is preferred because the light level changes at each switch position and thus something is seen to change in light level, indicating proper functioning. Alternatively, if the wiring connections were interchanged at the base terminals 19 and 22, the light-level sequence would be "off-low-high-high-off", and some people might suspect something wrong with no change in light level between the second and third switch positions.

The lamp unit, in each of its "high" and "low" light levels, functions in two sequential conditions: starting and operating. When the unit is turned on at "high" light level, via a-c voltage applied across the shell 16 and the ring terminal 19, voltage is applied to the lamp bulb cathodes 12, 13, and across the glow-starter switch 14, which causes gas (such as argon or neon) in the switch 14 to glow, and the heat thereof causes one or both of bimetal contacts 31, 32 to close together, causing current to flow through and heat the cathodes 12,13 to electron-emitting temperature. While the bimetal starting switch contacts 31,32 are thus closed, the gas ceases to glow and the contacts cool and open apart in about a second, causing an inductive voltage "kick" to occur in the reactor 18 which causes the heated cathodes 12,13 to emit electrons and start an electrical discharge in the gas (mercury, and argon or other starting gas) in the bulb which excites the phosphor on the inner bulb wall and generates visible light.

Starting the lamp 11 in the high-level condition with the reactor 18 in series with the bulb 11 as just described, is conventional and no problems. Also, the lamp will operate properly on "low" if quickly switched from high to low before the cathodes cool appreciably, even if the low-level ballast 21 is a conventional resistor or other impedance. However, starting the bulb 11 in the low-level condition from an off condition with an additional impedance such as an inductor, resistor or a capacitor in the circuit, may cause problems in reliable starting of the lamp 11 due to insufficient pre-heating current in the cathodes 12, 13 to bring their heat up to sufficient value to ensure electron-emissive discharge starting in the lamp when the starting switch 14 opens to induce lamp starting. Also, insufficient preheating of the cathodes at the instant of lamp starting (assuming the lamp starts) can cause electrons to be "pulled" from the cathode's electron emissive material by the starting voltage electrical field, thus damaging the electron emissive material.

In accordance with the invention, the thermistor 24 in the low-light level ballast 21 insures adequate prestarting current in the cathodes 12, 13, and may also function in the ballast circuit when the light bulb 11 is operating normally at low light level. The thermistor is a resistor which has a positive temperature coefficient of resistance, i.e. when its temperature increases, for example due to an increase in current through it, its resistance increases. Thermistors are available, and can be designed, with a large variety of resistance vs. temperature characteristics which can be linear, or non-linear such as providing an abrupt increase in resistance when the temperature rises to a certain value. Thermistors have been used for a variety of purposes, including current control in fluorescent lamp systems as is disclosed in U.S. Pat. Nos. 3,921,032 to Hallay and 4,162,430 to Cadoff et al. In the present invention, a thermistor 24 is connected in a low-light level ballast circuit so as to cause adequate pre-heat current in the lamp filaments and to thereafter cause or permit proper ballasting of the lamp.

Figure 3:
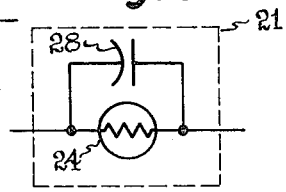
Figure 4:
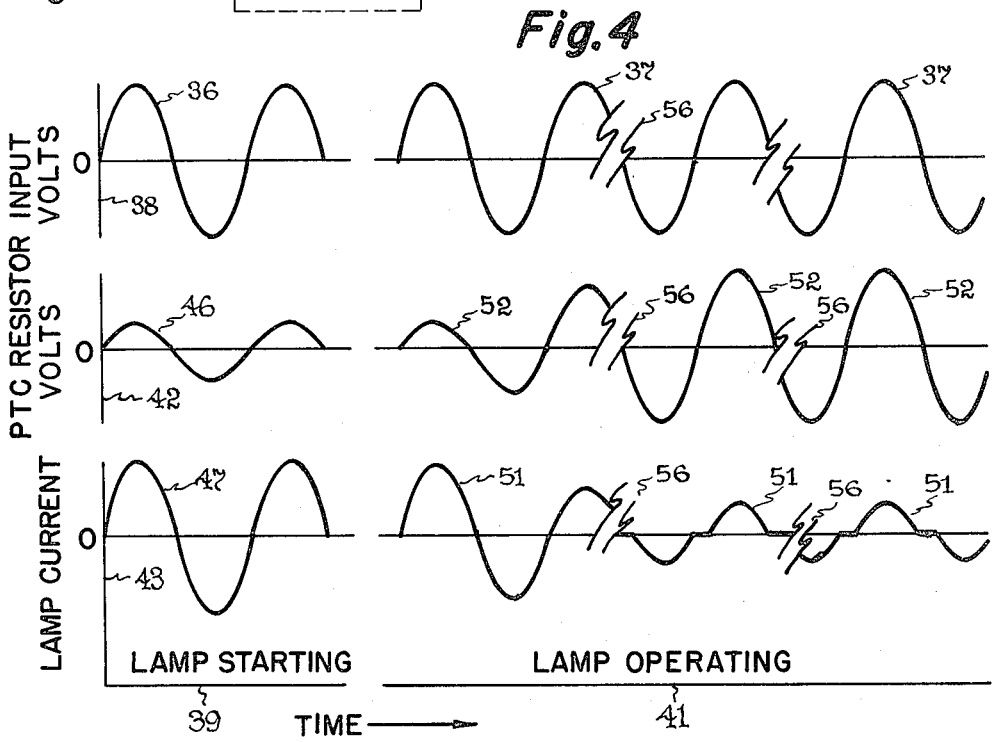
FIG. 4 is a graphical plot of voltage and current during starting and operation of the light unit at low light level.

FIG. 3 shows how the invention starts the light bulb 11 on the low-light level setting, when the socket center terminal 22 is activated and the low-light level circuit 21 is in series with the bulb 11. The upper curves 36, 37 illustrate the input voltage 38 across the socket terminals 16, 22 during low-level light condition, divided in time into lamp starting time 39 and lamp operating time 41. The next curve shows voltage 42 across the low-light ballast circuit 21 during the lamp starting and lamp operating, and the third curve shows the lamp current 43 during lamp starting and lamp operating. The low-light ballast circuit 21, comprising the thermistor 24 alone or in combination with one or more resistors 26, 27 and/or capacitor 28, is designed to have a relatively low impedance at ambient temperature and during preheating of the cathodes 12, 13 while the starting switch 14 is closed (during starting time 39) and to have a relatively higher impedance (due to current heating and increased resistance of the thermistor 24) to ballast the lamp 11 during normal low-light level operation. By the termistor 24 having a low impedance during cathode pre-heat, its voltage drop 46 is relatively low and the cathode pre-heat current 47 is relatively high and about the same value as for starting at the high-light level, to insure adequate cathode heat, for reliable starting of the lamp 11. Further in accordance with the invention, the reactor 18 is in electrical series with the impedance 21 to provide an additional function of limiting preheat cathode current to a safe value during the intervals when the low-light level ballast 21 is a low impedance. If the starting switch 14 remains closed for one second, which is typical, for causing preheating of the cathodes, there will be 60 cycles of the voltages and current 36, 46, 47 during lamp starting (assuming a 60 Hz power source). For clarity, FIG. 3 shows only one of these cycles.

After the lamp 11 starts and is operating, its discharge current 51 is lower than the pre-heat cathode current 47, and thus the current in the low-level ballast 21 is lower; however the thermistor 24 continues to heat and its voltage drop 52 rises to provide the circuit 21 (in cooperation with reactor 18) with proper impedance for low-level ballasting of the lamp 11. The slight discontinuities at the zero crossings of curve 51 are caused by a slight time delay in starting of the lamp's discharge at each half-cycle of operation. The breaks 56 in the curves 51 and 52 indicate elapsed time; it is considered acceptable if the termistor circuit 21 takes up to 10 seconds to heat and normalize to an impedance value for continuous operation of the lamp 11 at low-level light output. Optimum values and characteristics of the low-light thermistor 24 and the resistors 26,27 and/or capacitor 28, can be chosen by calculation or by experiment, with respect to the desired value of low-light level lamp current 51 and the required filament pre-heat current. The resistors 26,27 and/or capacitor 28 are provided if required to tailor the circuit 21 to desired characteristics. For example, the thermistor 24 may be a type having an ambient temperature resistance of 4 ohms, a resistance at starting of lamp 11 of about 4 ohms, and a resistance of about 135 ohms during low-level lamp operation. Also, for example, the resistors 26 and 27 can be about 300 ohms and about 5 ohms respectively, and the resistance of thermistor 24 when the lamp is operating on "low" can be about 500 ohms. In FIG. 3, the thermistor 24 resistance when the lamp is operating on "low" can be about 6,000 ohms and the capacitor 28 can be about 3 microfarads. The temperature-resistance characteristics of the thermistor 24 can further be tailored and controlled by its heat environment—i.e. by covering or enclosing it (for greater heat and increase in resistance vs. current in it), or by heat-sinking it, such as placing it against the metal core of the reactor 18 (for lower heating effect), to cause the thermistor to cool faster after the lamp is turned off so that it will be in a low-resistance condition to cause proper restarting of the lamp at low light level.

The invention has been found to achieve its objectives of providing a feasible low-cost multiple light level fluorescent lamp unit, and such a lamp unit in which both the high-light level circuit and the low-light level circuit can be provided in the central ballast hub unit disclosed in the above-referenced Metoff patent application.

The invention's light level sequence of off-high-low-high-off is contrary to and unique from the long-conventional concept of the sequence off-low-higher, etc. and is an improvement thereover, as explained above, for a two light-level lamp.

While preferred embodiments and modifications of the invention have been shown and described, various other embodiments and modifications thereof will become apparent to persons skilled in the art and will fall within the scope of the invention as defined in the following claims.

I claim:

1. A multiple light level gas discharge light unit, such as a fluorescent light unit, for operation from a-c electrical power, comprising a gas discharge light bulb having a pair of cathodes therein, a three-terminal base, means connecting a first end of one of said cathodes to a first terminal of said base, a ballast reactor connected between a first end of the other of said cathodes and a second terminal of said base and adapted to ballast said light bulb at a relatively high light level, and ballast circuit means connected between said second terminal and a third terminal of said base and adapted to ballast said light bulb at a relatively low light level in cooperation with said ballast reactor, said ballast circuit means comprising an impedance circuit connected between said second and third base terminals, and said light unit including a starter switch connected between the remaining ends of said cathodes and adapted to close for a period of time when electrical power is applied to said base, in order to cause preheat current to flow through said filaments, and thereafter be in open condition when said light bulb is operating, said impedance circuit being adapted to have a relatively low impedance during said preheatng of the cathodes for said relatively low light level operation and thereafter having a relatively higher impedance during low light level operation of the lamp.

2. A light unit as claimed in claim 1, in which said impedance circuit includes an impedance means having a variable impedance which increases in value after said preheating of the cathodes.

3. A light unit as claimed in claim 2, in which said impedance means is a thermistor.

4. A light unit as claimed in claim 3, including a resistor connected across said termistor.

5. A light unit as claimed in claim 3, including a resistor connected in series with said thermistor.

6. A light unit as claimed in claim 5, including a resistor connected across said thermistor.

7. A light unit as claimed in claim 3, including a capacitor connected across said thermistor.

8. A light unit as claimed in claim 3, in which said light unit is connected to said base to provide sequential light levels of off-high-low-high-off.

9. A light unit as claimed in claim 8, including a discharge lamp bulb and a three-way type of base having a shell, ring terminal, and a center terminal, said circuit means comprising high-light level ballast means connected between said lamp bulb and said ring terminal, and low-light level ballast means connected between said lamp bulb and said center terminal.

10. A light unit as claimed in claim 9, in which said high-light level ballast means comprises a reactor, and in which said low-light level ballast means comprises an impedance means connected in series with said reactor.

11. A light unit as claimed in claim 10, in which said impedance means has a relatively low impedance value during starting of said lamp bulb, and a relatively higher impedance value during operation of said lamp bulb, at the low-light level setting of said light unit.

* * * * *